United States Patent [19]

Takeda

[11] 4,327,675

[45] May 4, 1982

[54] FUEL INJECTION TYPE INTERNAL COMBUSTION ENGINE

[75] Inventor: Keiso Takeda, Susono, Japan

[73] Assignee: Toyota Jidosha Kogyo Kabushiki Kaisha, Toyota, Japan

[21] Appl. No.: 68,748

[22] Filed: Aug. 23, 1979

[30] Foreign Application Priority Data

Jan. 23, 1979 [JP] Japan ..... 54-5534

[51] Int. Cl.[3] ..... F02M 51/08

[52] U.S. Cl. ..... 123/52 M; 123/470; 123/472; 261/78 R; 261/DIG. 39; 261/DIG. 74; 261/DIG. 82

[58] Field of Search ..... 123/119 R, 32 FA, 52 M, 123/139 AW, 28, 29, 32 JV, 32 F, 32 G, 445, 470, 472, 478, 531; 261/115, 118, 78 R, DIG. 39, 74

[56] References Cited

U.S. PATENT DOCUMENTS

| | | | |
|---|---|---|---|
| 2,869,527 | 1/1959 | Groves | 123/139 AW |
| 3,919,992 | 11/1975 | Eckert | 123/457 |
| 4,034,733 | 7/1977 | Noguchi et al. | 123/480 X |
| 4,088,104 | 5/1978 | Ibbott | 123/531 |
| 4,132,203 | 1/1979 | Elpern et al. | 123/139 AW |
| 4,211,191 | 7/1980 | Kawamura et al. | 123/445 X |
| 4,216,753 | 8/1980 | Inoue et al. | 123/531 X |
| 4,235,210 | 11/1980 | Sumiyoshi et al. | 123/470 X |
| 4,253,441 | 3/1981 | Kawamura et al. | 123/445 |

FOREIGN PATENT DOCUMENTS

| | | | |
|---|---|---|---|
| 2543242 | 4/1977 | Fed. Rep. of Germany | 123/139 AW |
| 2807345 | 8/1978 | Fed. Rep. of Germany | 123/32 JV |
| 64219 | 11/1955 | France | 123/139 AW |
| 55-37555 | 3/1980 | Japan | 123/472 |
| 950776 | 2/1964 | United Kingdom | 123/139 AW |

*Primary Examiner*—Tony M. Argenbright
*Attorney, Agent, or Firm*—Kenyon & Kenyon

[57] ABSTRACT

An internal combustion engine comprising a vertically extending intake duct which is mounted on the collecting portion of the intake manifold. A throttle valve and a fuel injector are arranged in the intake duct. The fuel nozzle of the fuel injector is directed slightly downwards and located at a position spaced below the throttle shaft of throttle valve by a distance which is less than one half of the diameter of the intake passage formed in the intake duct.

11 Claims, 7 Drawing Figures

FUEL INJECTION TYPE INTERNAL COMBUSTION ENGINE

DESCRIPTION OF THE INVENTION

The present invention relates to a fuel injection type internal combustion engine.

As an internal combustion engine of a gasoline injection type, there has been proposed an engine in which a fuel injector is provided for each cylinder, and the fuel is injected from each of the fuel injectors into the intake ports of the corresponding cylinders. This engine has an advantage in that the distribution of fuel to each cylinder becomes uniform. However, in this engine, there is a problem in that the atomization of the fuel fed into the combustion chambers from the fuel injectors is not fully promoted, and that the provision of a plurality of the fuel injectors is necessary.

In order to eliminate the above-mentioned problem, another internal combustion engine has been proposed, in which a single fuel injector is arranged upstream of the throttle valve in the intake duct which is connected to the collecting portion of the intake manifold. This engine has advantages in that, since the fuel injected from the fuel injector impinges upon the throttle valve, the atomization of the fuel is promoted, and in that the vaporization of the fuel is further promoted during the time the fuel flows within the intake manifold. However, in this engine there are also problems. Since the amount of the fuel distributed to each cylinder varies between the cylinders in accordance with changes in the opening degree of the throttle valve, the irregularity of the air-fuel ratio in each cylinder becomes large, and since it takes long time until the fuel injected from the fuel injector reaches the combustion chambers, the time lag in the response to the controlling operation of the fuel injection is increased.

Another internal combustion engine has been proposed in which a single fuel injector is so arranged that fuel is injected into the collecting portion of the intake manifold from the fuel injector. This engine has an advantage in that the responsiveness to the controlling operation of the fuel injection is improved as compared with the case wherein the fuel injector is arranged at a position located upstream of the throttle valve as mentioned above. However, in this engine the atomization of the fuel injected from the fuel injector is not fully promoted, as compared with the case wherein the fuel injector is arranged at a position located upstream of the throttle valve, and in addition, since slight changes in the location of the fuel injector and in the injecting direction of the fuel injector cause a great change in the distribution of the fuel to each cylinder, it is difficult, in practice to find the optimum location and the optimum injecting direction of the fuel injector.

An object of the present invention is to provide a fuel injected internal combustion engine capable of fully promoting the atomization of fuel and capable of obtaining a uniform distribution of the fuel to each cylinder, as well as capable of ensuring good responsiveness to the controlling operation of the fuel injection.

According to the present invention, there is provided a fuel injection type internal combustion engine comprising: an engine body; an intake manifold fixed onto said engine body and having a collecting portion; an intake duct substantially vertically and upwardly extending from said collecting portion and defining an intake passage therein; a throttle valve arranged in said intake passage and having a throttle shaft; and a swirl type fuel injector having a fuel nozzle which is directed downwards and is arranged in said intake passage at a position spaced below said throttle shaft by a distance less than one half of the diameter of said intake passage.

The present invention may be more fully understood from the description of preferred embodiments of the invention set forth below, together with the accompanying drawings.

DESCRIPTION OF PREFERRED EMBODIMENTS

Figure 1:
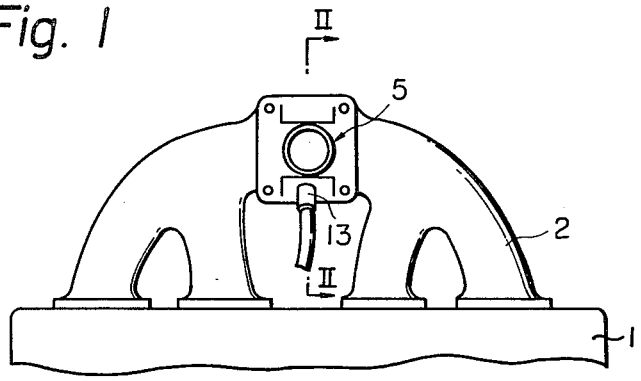
FIG. 1 is a plan view of a part of an embodiment of an internal combustion engine according to the present invention.
Figure 2:
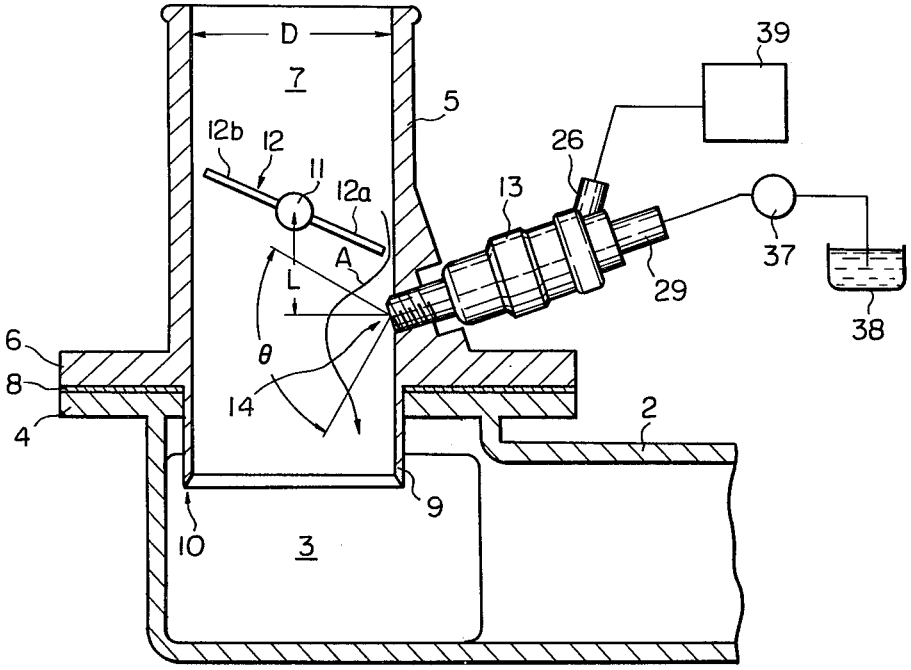
FIG. 2 is a cross-sectional side view taken along the line II—II in FIG. 1.

Referring to FIGS. 1 and 2, 1 designates an engine body, 2 an intake manifold fixed onto the engine body 1, and 3 a collecting portion of the intake manifold 2; 4 designates a horizontally extending manifold flange formed in one piece on the intake manifold 2 and arranged above the collecting portion 3, and 5 an approximately cylindrical intake duct having a mounting flange 6 which is formed in one piece of the lower end of the intake duct 5. A cylindrical intake passage 7 extending vertically and having a substantially uniform cross-section is formed in the intake duct 5. As illustrated in FIG. 2, the mounting flange 6 of the intake duct 5 is fixed onto the manifold flange 4 via a gasket 8, and a cylindrical member 9 having a thin wall and projecting downwards into the collecting portion 3 of the intake manifold 2 is formed in one piece on the lower end of the intake duct 5. The lower end 10 of the cylindrical member 9 has a knife edge shape and is arranged so as to be spaced from the peripheral side wall of the collecting portion 3 of the intake manifold 2. A throttle shaft 11 extending parallel to the longitudinal axis of the engine body 1 (FIG. 1) is arranged in the intake passage 7, and a throttle valve 12, which is shaped in the form of a butterfly valve, is fixed onto the throttle shaft 11. For the sake of easier explanation, hereinafter the valve plate of the throttle valve 12, which is located at a position near the engine body 1 (FIG. 1) with respect to the throttle shaft 11, is referred to as a right valve plate 12*a*, and the valve plate of the throttle valve 12, which is located at a position remote from the engine body 1 (FIG. 1) with respect to the throttle shaft 11, is referred to as a left valve plate 12*b*. The throttle shaft 11 of the throttle valve 12 is connected to the accelerator pedal (not shown), so that the throttle valve 12 is rotated in the clockwise direction when the accelerator pedal is depressed. A swirl type fuel injector 13 is arranged on the inner wall of the intake passage 7 at a position downstream of the throttle valve 12 and near the engine body 1 (FIG. 1). As illustrated in FIG. 2, the fuel injector 13 is so arranged that a fuel nozzle 14 thereof is directed slightly downwards, and so that the axial distance L between the fuel nozzle 14 and the throttle shaft 11 is less than one half of the diameter D of the intake passage 7.

Figure 3:
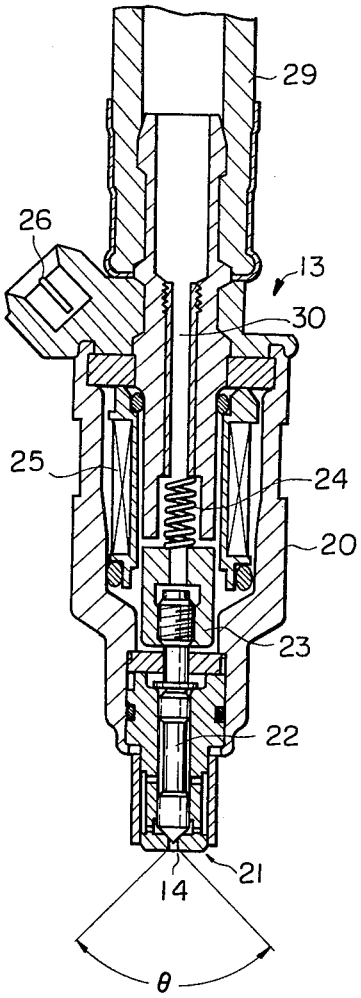
FIG. 3 is a cross-sectional side view of the fuel injector illustrated in FIG. 2.
Figure 4:
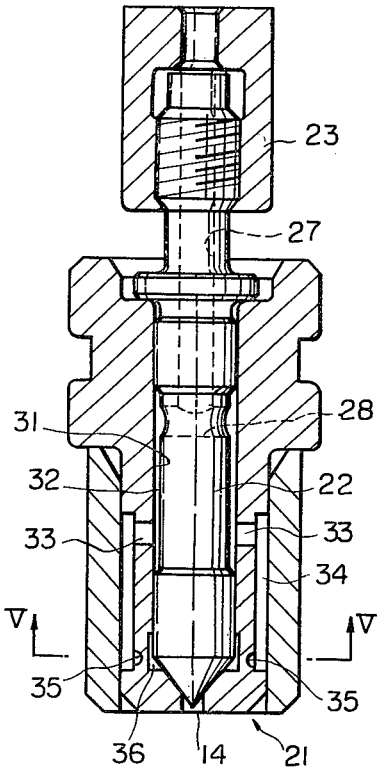
FIG. 4 is an enlarged cross-sectional side view of a part of the fuel injector illustrated in FIG. 3.
Figure 5:
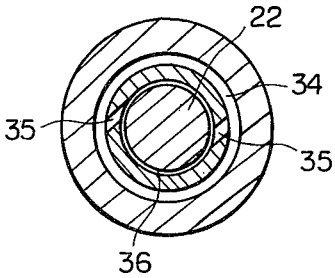
FIG. 5 is a cross-sectional view taken along the line V—V in FIG. 4.

Referring to FIGS. 3 and 4, reference numeral 20 designates an injector housing, 21 a valve holder fixed onto the tip of the housing 20, 22 a needle reciprocally movable within the valve holder 21 for controlling the opening operation of the fuel nozzle 14 and 23 a movable core fixed onto the upper end of the movable needle 22; 24 designates a compression spring for biasing the movable needle 22 towards the fuel nozzle 14, 25 a solenoid for attracting the movable core 23, and 26 a connector for supplying the solenoid 25 with electric power. As illustrated by the broken lines in FIG. 4, an axial bore 27 and a radial bore 28 are formed within the movable needle 22. Consequently, the fuel fed into a fuel passage 30 (FIG. 3) from a fuel conduit 29 is fed via the axial bore 27 and the radial bore 28 into an annular chamber 32 formed between the movable needle 22 and a cylindrical inner wall 31 of the valve holder 21. As illustrated in FIGS. 4 and 5, the annular chamber 32 is connected to a swirl chamber 36 via a pair of radial bores 33, an annular chamber 34 and a pair of fuel ports 35. On the other hand, as illustrated in FIG. 2, the fuel conduit 29 of the fuel injector 13 is connected to a fuel tank 38 via a fuel pump 37. In addition, the connectors 26 of the solenoid 25 of the fuel injector 13 are connected to an electronic control circuit 39 for controlling the injecting operation of the fuel injector 13.

Turning to FIGS. 3 and 4, when the solenoid 25 is energized in response to the output signal of the electronic control circuit 39 (FIG. 2) and, as a result, the movable needle 22 opens the fuel nozzle 14, the fuel fed into the annular chamber 32 from the fuel conduit 29 flows into the swirl chamber 36 via the radial bores 33, the annular chamber 34 and the fuel ports 35, and then the fuel is injected from the fuel nozzle 14. As illustrated in FIG. 5, both the fuel ports 35 are tangentially connected to the circumferential inner wall of the swirl chamber 36. Consequently, when the movable needle 22 opens the fuel nozzle 14, a strong swirl motion of the fuel is created in the swirl chamber 36 by the fuel flowing into the swirl chamber 36 from the fuel ports 35. Then the swirling fuel in the swirl chamber 36 is injected, while swirling, from the fuel nozzle 14 and, as a result, the fuel injected from the fuel nozzle 14 spreads as illustrated in FIG. 3 due to the centrifugal force caused by the swirling motion. As mentioned above, in the swirl type fuel injector 13 as illustrated in FIG. 2, since the fuel injected from the fuel injector 13 spreads while swirling, the atomization of the fuel is extremely promoted. In addition, in the case wherein the fuel injector 13 is arranged as illustrated in FIG. 2, it has been proven that it is preferable that the injection angle shown by $\theta$ in FIGS. 2 and 3 be in the range of 60 through 120 degrees. In addition, it has been also proven that it is most preferable that the injection angle $\theta$ be equal to an approximate 90 degree.

When the opening degree of the throttle valve 12 is small and, thus, the engine is operating under a light load as illustrated in FIG. 2, based on observations using the schlieren photography process, it has been proven that the velocity of the air flowing between the right valve plate **12*a* and the inner wall of the intake passage 7 is higher than that of the air flowing between the left valve plate 12*b* and the inner wall of the intake passage 7, and that after the air stream which has passed between the right valve plate 12*a* and the inner wall of the intake passage 7 moves downwards towards the center of the intake passage 7 away from the inner wall of the intake passage 7, as illustrated by the arrow A in FIG. 2, the air stream again approaches the inner wall of the intake passage 7 and then flows downwards along the inner wall of the intake passage 7. Consequently, by positioning the fuel nozzle 14 of the fuel injector 13 at a position spaced below the throttle shaft 11 by the distance L, the fuel injected from the fuel injector 13 is pushed towards the central portion of the intake passage 7 by the air stream flowing as illustrated by the arrow A in FIG. 2. As a result, the fuel injected from the fuel, injector 13 is uniformly distributed within the intake passage 7. In addition, by using the swirl type main fuel injector 13, the atomization of the fuel is promoted. Furthermore, since the fuel injector 13 is arranged downstream of the right valve plate 12*a*, so that the air stream passing around the right valve plate 12*a* at a speed which is higher than that of the air stream passing around the left valve plate 12*b* flows in front of the fuel nozzle 14 of the fuel injector 13, the fuel injected from the fuel nozzle 13 is divided into fine droplets by the higher speed air stream, and thus, the atomization of the main fuel is further promoted. Then the fuel thus divided into fine droplets flows into the collecting portion 3 of the intake manifold 2 together with the sucked air. At this time, the liquid fuel adhering onto the inner wall of the intake passage 7 and flowing downwards along the inner wall of the intake passage 7 is sheared into fine droplets at the knife edge shape lower end 10 of the cylindrical member 9; thus, the atomization of the liquid fuel adhering onto the inner wall of the intake passage 7 is promoted. Vaporization of the fuel flowing into the collecting portion 3 is promoted, further during the time the fuel flows within the intake manifold 2, and then the fuel is fed into the cylinders of the engine. As mentioned above, since the atomization and the vaporization of the fuel are promoted when the fuel injected from the fuel injector 13 flows into the collecting portion 3 of the intake manifold 2, the distribution of the fuel to each cylinder becomes uniform. In addition, since the fuel injected from the fuel injector 13** is immediately fed into the cylinders of the engine, a good responsiveness to the controlling operation of the fuel injection can be ensured.

Figure 6:
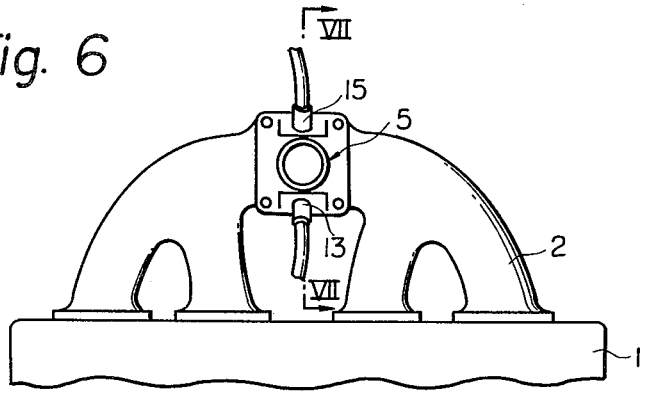
FIG. 6 is a plan view of a part of another embodiment according to the present invention.
Figure 7:
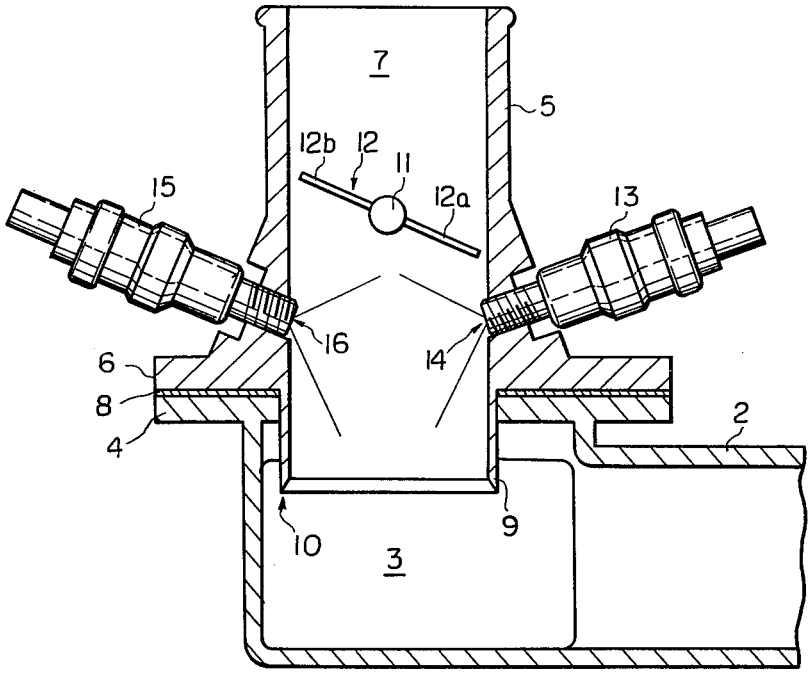
FIG. 7 is a cross-sectional side view taken along the line VII—VII in FIG. 6.

Referring to FIGS. 6 and 7, another swirl type fuel injector 15 is provided in addition to the fuel injector 13. The fuel injector 15 is arranged on the inner wall of the intake passage 7 at a position opposite to the inner wall on which the main fuel injector 13 is arranged. The fuel injector 15 is so arranged that a fuel nozzle 16 thereof is positioned at a level which is almost the same as the level of the fuel nozzle 14 of the main fuel injector 13, and the fuel nozzle 16 is directed slightly downwards. The fuel injector 15 has a construction which is the same as that of the fuel injector 13.

In the embodiments illustrated in FIGS. 1 and 6, the amount of the fuel injected from the fuel injectors 13, 15 is controlled by means of the electronic control circuit 39 (FIG. 2) so that an optimum air-fuel ratio of the mixture fed into the cylinders is always obtained, even with change in the operating condition of the engine. In addition, in the embodiments illustrated in FIGS. 1 and 6, the fuel is intermittently injected from the fuel injectors 13, 15. However, instead of intermittently injecting the fuel from the fuel injectors 13, 15, the fuel may be continuously injected from the fuel injectors 13, 15.

In a conventional engine, since when the amount of the sucked air is large, it flows within the intake passage 7 at a high speed, and good atomization of the fuel can be ensured. Consequently, in this case the distribution of fuel to each cylinder becomes approximately uniform, regardless of the location and the injecting direction of the fuel injectors 13, 15. On the other hand, when the amount of the sucked air is small, that is, when the engine is operating under an idling condition or a light load, since the velocity of the sucked air flowing within the intake passage 7 is very low, a satisfactory atomization of the fuel cannot be expected. However, in the present invention, by using swirl type fuel injectors and arranging the fuel injectors as illustrated in FIGS. 2 and 7, the atomization and the vaporization of the fuel injected from the fuel injectors 13, 15 are extremely promoted. Consequently, even if the amount of the sucked air is small, the distribution of fuel to each cylinder becomes uniform.

While the invention has been described by reference to specific embodiments chosen for purposes of illustration, it should be apparent that numerous modifications could be made thereto by those skilled in the art without departing from the spirit and scope of the invention.

What is claimed is:

1. A fuel injection type internal combustion engine comprising:

an engine body;

an intake manifold fixed onto said engine body and having a collecting portion;

an intake duct extending substantially vertically upwardly from said collecting portion and defining an intake passage therein, said intake passage having a substantially uniform cross section;

a throttle valve arranged in said intake passage and having a throttle shaft; and a swirl type fuel injector having a fuel nozzle which is directed slightly downwards and is arranged in said constant cross section intake passage at a position spaced below said throttle shaft by a distance less than one half of the diameter of said intake passage on the side of the throttle valve which moves downwardly relative to the throttle shaft when the valve is opened, such that said downward opening side of the throttle valve enters into the region of the fuel spray when the throttle valve is opened to a great extent.

2. A fuel injection type internal combustion engine as claimed in claim 1, wherein said throttle shaft is arranged to extend horizontally and parallel to a longitudinal axis of said engine body.

3. A fuel injection type internal combustion engine as claimed in claim 1, wherein the injection angle of said fuel injector is in the range of 60 through 120 degrees.

4. A fuel injection type internal combustion engine as claimed in claim 3, wherein said injection angle is about 90 degrees.

5. A fuel injection type internal combustion engine as claimed in claim 1, wherein the lower end of said intake duct comprises a cylindrical member projecting downwards into said collecting portion and spaced laterally from a circumferential wall of said collecting portion.

6. A fuel injection type internal combustion engine as claimed in claim 5, wherein said cylindrical has a lower end having a knife edge shape.

7. A fuel injection type internal combustion engine as claimed in claim 1, wherein said engine further comprises another swirl type fuel injector having a fuel nozzle arranged in said intake passage at a position diametrically opposite to the fuel nozzle of said first mentioned fuel injector.

8. A fuel injection type internal combustion engine as claimed in claim 7, wherein the fuel nozzle of said other fuel injector is directed slightly downwards.

9. A fuel injection type internal combustion engine as claimed in claim 7, wherein the fuel nozzle of said other fuel injector is arranged at a level which is approximately the same as that of the fuel nozzle of said first mentioned fuel injector.

10. A fuel injection type internal combustion engine as claimed in claim 7, wherein the injection angle of said other fuel injector is in the range of 60 through 120 degrees.

11. A fuel injection type internal combustion engine as claimed in claim 10, wherein the injection angle of said other fuel injector is about 90 degrees.

* * * * *